US005803953A

United States Patent [19]

Rojey et al.

[11] Patent Number: 5,803,953

[45] Date of Patent: Sep. 8, 1998

[54] PROCESS FOR TREATMENT OF NATURAL GAS AT A STORAGE SITE

[75] Inventors: Alexandre Rojey; Michel Thomas; Sophie Jullian, all of Rueil Malmaison, France

[73] Assignee: Institut Francais du Petrole, Cedex, France

[21] Appl. No.: 774,700

[22] Filed: Dec. 26, 1996

[30] Foreign Application Priority Data

Dec. 27, 1995 [FR] France ..... 95 15524

[51] Int. Cl.[6] ..... B01D 53/04

[52] U.S. Cl. ..... 95/105; 95/122; 95/136; 95/143

[58] Field of Search ..... 95/104, 105, 116, 95/122, 136, 141, 143, 147, 148

[56] References Cited

U.S. PATENT DOCUMENTS

| | | | |
|---|---|---|---|
| 3,883,637 | 5/1975 | Benedict | 95/141 X |
| 4,421,532 | 12/1983 | Sacchetti et al. | 95/104 |
| 4,795,482 | 1/1989 | Gioffre et al. | 95/141 |
| 4,966,611 | 10/1990 | Schumacher et al. | 95/141 X |
| 5,082,475 | 1/1992 | Bentz | 95/143 X |
| 5,085,674 | 2/1992 | Leavitt | 95/143 X |
| 5,139,542 | 8/1992 | Sowinski | 95/147 |
| 5,139,543 | 8/1992 | Sowinski | 95/147 |
| 5,141,533 | 8/1992 | Sowinski | 95/147 |
| 5,144,807 | 9/1992 | Brown | 95/143 X |
| 5,234,479 | 8/1993 | Henderson et al. | 95/105 |
| 5,354,362 | 10/1994 | Sowinski | 95/141 X |

FOREIGN PATENT DOCUMENTS 43 27 522 2/1995 Germany .

*Primary Examiner*—Robert Spitzer
*Attorney, Agent, or Firm*—Millen, White, Zelano & Branigan, P.C.

[57] ABSTRACT

A process for the treatment of natural gas that contains an odorant at a storage site is described, with this process including a storage phase and a draw-down phase which involve at least two adsorbers A and B and in which, during the storage phase, the odorant is extracted from the gas and, during the draw-down phase; the water and $H_2S$ that are contained in the gas are extracted.

16 Claims, 2 Drawing Sheets

PROCESS FOR TREATMENT OF NATURAL GAS AT A STORAGE SITE

BACKGROUND OF THE INVENTION

The invention relates to a process for the treatment of natural gas at a storage site, such as, for example, underground storage.

More particularly, it has as its object the treatment of natural gas by a single process that uses adsorbents, both during the storage period and during the draw-down period at the storage sites.

In many countries, including France, the gas that is intended for public distribution must have a characteristic odor. To do this, when the mercaptan content does not make it possible to reach the required level of the scale of olfactory intensity, it is necessary to odorize the gas.

This is done by adding a condensable odorant which is, for example, tetrahydrothiophene THT ($C_4H_8S$), at a ratio of, for example, 20 to 25 mg/Nm3.

The odorant can also be a mercaptan that is pure or mixed with a light alcohol, for example, methanol.

The odorization is carried out at each of the points in the transmission network by means of centralized odorization units that are found at:

the stations for delivering gas to the borders;

the tanker terminals; and the outlets from underground storage.

The odorant is injected into the delivery stations before the gas is stored. During the storage period, in the case of underground storage, the odorant and the sulfur-containing products are partially adsorbed in the porous medium. In addition, during treatment on site to bring the gas up to the specifications of the network, a portion of the odorant is lost with the products to be eliminated.

Overall, almost half of the odorant that is initially present in the gas before storage is likely to be eliminated during the various stages. For this reason, during the recovery of the gas (draw-down phase), a large addition of odorant is necessary, which constitutes an expensive operation.

At the underground storage sites, during the draw-down phase that is carried out in, for example, winter, operations to bring the gas up to network specifications are necessary and include operations for dehydrating and desulfurizing the gas.

Actually, when it comes out of storage, the gas is generally saturated with water, and it must be dehydrated to meet network specifications, for example 20 to 50 mg/Nm3 of gas. Likewise, the gas can contain hydrogen sulfide $H_2S$, which may form in the tank owing to bacterial action, and it must be treated to meet the required specifications in the network, which is generally several ppm, for example, 7 mg/Nm3. In practice, the traditional techniques for dehydration (for example, scrubbing, with glycol) and desulfuration (for example, scrubbing with amines, or other chemical processes) are used separately.

SUMMARY OF THE INVENTION

An object of the invention is to provide an adsorption process that makes it possible, during the storage phases, to separate the odorant from the gas that is sent into storage and to treat, during the draw-down phases, the gas that comes out of storage to meet network specifications.

Upon further study of the specification and appended claims, further objects and advantages of this invention will become apparent to those skilled in the art.

It has been found that it is possible to use the same installation for:

(A) deodorizing the gas that is withdrawn from the network and to recover the odorant before injection into the storage tank during the storage phases; and (B) to dehydrate and desulfurize the gas coming from the storage tank before sending it to the network during the draw-down phases.

The process according to the invention uses at least two adsorption zones, with at least one of said zones operating alternately under adsorption conditions and under desorption conditions, and a desorption circuit where one portion of the treated gas is reused to regenerate the bed that is saturated with impurities. The molecular sieves that are used are conventional, such as, for example, zeolite sieves A and particularly sieve 5A, sieves X and Y or those of the MFI type. They constitute, separately or in a mixture, an adsorbent that is appropriate both for adsorption of the odorant during the storage phase and for adsorption of $H_2S$ and $H_2O$ during the draw-down phase.

A particularly significant advantage of the process lies in the fact that the same process is used during the phase for storing the gas that is obtained from the network to separate the odorant and the draw-down phase for the treatment of the gas that is obtained from the tank, as described below wherein:

DETAILED DESCRIPTION OF THE DRAWINGS

Figure 1:
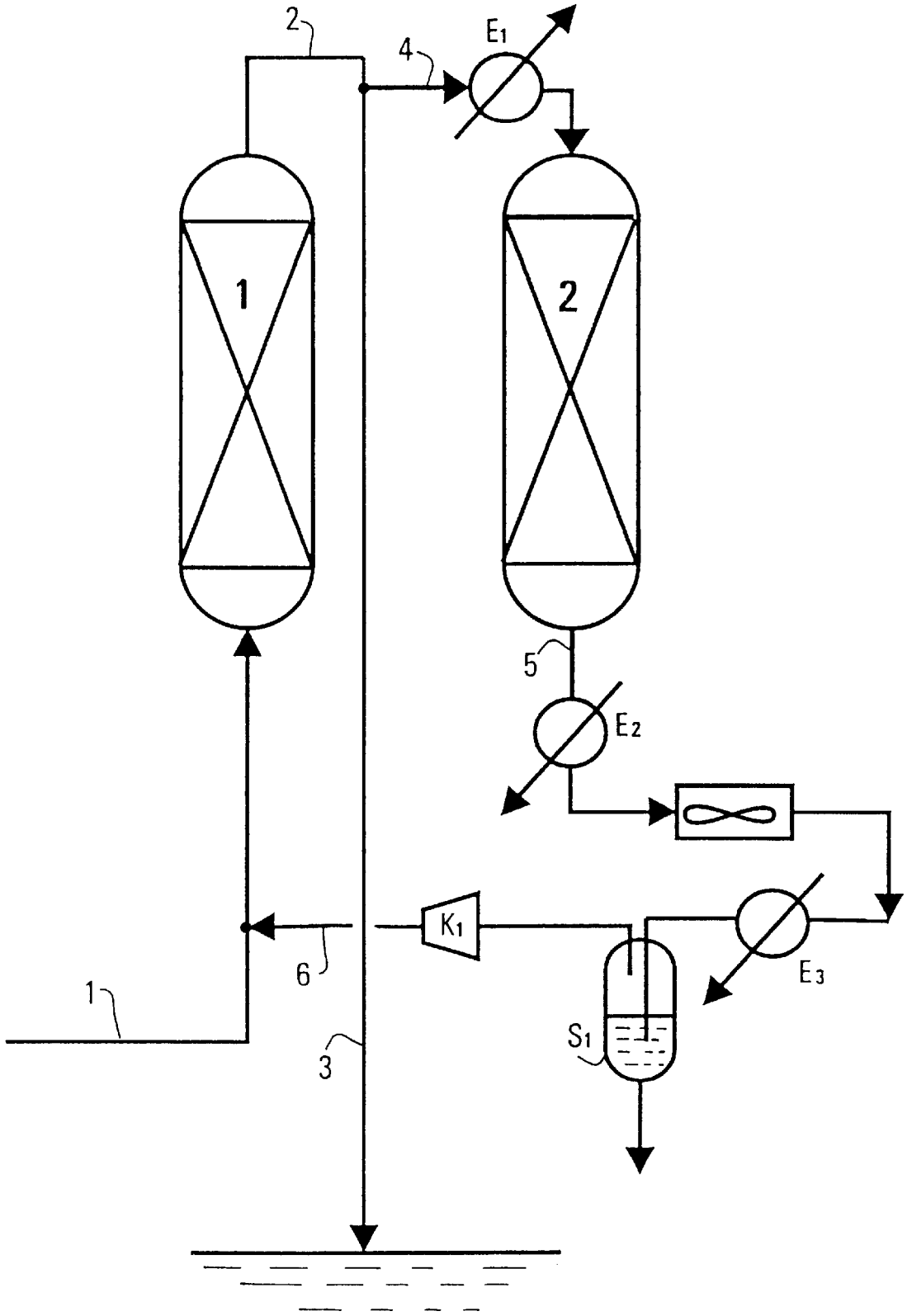
FIG. 1 is a schematic flowsheet of the storage phase.

In connection with FIG. 1, initially, a regenerated adsorber A operates in adsorption mode 1, and an adsorber B that is precharged with odorant operates in regeneration mode 2. The gas that is obtained from the network and that contains odorant is sent via line 1 to the bottom of adsorber A. The odorant is held in the micropores of the adsorbent, and the gas that is produced at the top via line 2 is therefore deodorised. At least a portion of this gas (for example, from 70 to 95% and preferably from 80 to 85%) is sent via line 3 directly into the storage tank; the rest (5 to 30% and preferably 15 to 20%) is sent via line 4 as a regenerating gas into adsorber B, which operates in regeneration mode 2. This gas is heated by means of, for example, a furnace E1 to a suitable temperature before being injected at the top of adsorber B. In the latter, it desorbs the odorant that is contained in the micropores. The gas that is recovered at the bottom via line 5 is therefore a gas that is charged with odorant. It is then cooled in an exchanger E2, which can be followed by a cooling tower and cooling with water E3. The odorant in the liquid phase is then recovered in a separator S1. It is possible to use any standard separator that is known to one skilled in the art. In a variant of the process, regeneration can be done by circulating the regenerating gas from bottom to top in adsorber B.

Adsorber B in mode 2 is therefore gradually regenerated by elimination of the odorant, which is recovered so that it can be reinjected later during the draw-down phases.

After separation of the odorant, the gas that has been used for the regeneration of adsorber B contains the odorant at a content that is equal to its partial pressure at the temperature of the separator. It is then sent back via line 6 and, after compression in compressor K1, is mixed with the gas that is obtained from the network via line 1 to be introduced into adsorber A in mode 1.

The conditions of use are selected such that the gas that is drawn off constitutes the regeneration agent. It therefore is not necessary to use an additional agent, which can be costly to supply.

The adsorbers can be filled with a single shaped adsorbent or several layers of different adsorbents.

The set of the two adsorption zones that are thus used makes it possible to produce a deodorized gas, which can be sent into storage, and at the same time to recover the odorant, which can be reinjected during a subsequent draw-down phase.

During a storage phase, which can last, for example, for one hundred days, the duration of the adsorption half-period for one of two adsorbers A and B can vary between several hours and several days. The regeneration is carried out over several hours, for example from 5 to 10 hours, and then the regenerated adsorber is kept as is, in mode 2, before replacing in mode 1 the adsorber that is saturated with odorant at the end of the adsorption half-period.

Figure 2:
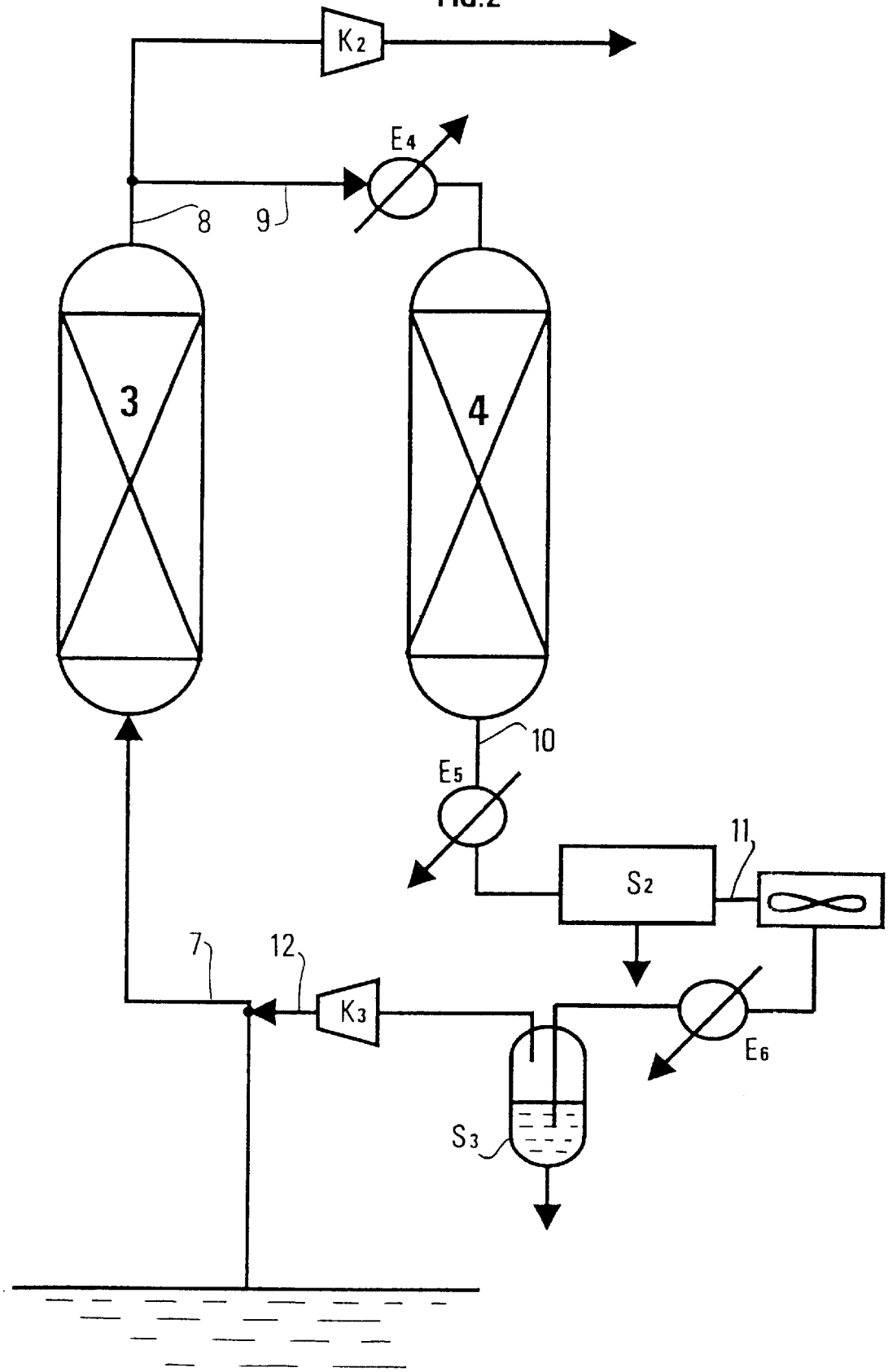
FIG. 2 is a schematic flowsheet of the draw-down phase.

The draw-down phase will now be described in detail below in connection with FIG. 2. For example, adsorber A is initially in adsorption mode 3, while adsorber B, which is saturated with impurities (water and $H_2S$), is in regeneration mode 4. The gas that is drawn off from the tank, saturated with water, is sent to the bottom of adsorber A via line 7. The water and hydrogen sulfide are held in the micropores of the adsorbent, and the gas that is produced at the top via line 8 therefore meets the specifications of the network. One portion (generally 70 to 95% and preferably 80 to 85%) of this gas is sent directly into the network after the traditional stages of recompression (K2); another portion (either 5 to 30% and preferably 15 to 20%) is sent via line 9 to be used as a gas for regenerating adsorber B in mode 4. This gas that is used for regeneration is heated by means of, for example, a furnace E4, to a suitable temperature before being injected at the top of adsorber B, where it desorbs the impurities ($H_2O$, $H_2S$) that are contained in the micropores. The gas that is recovered at the bottom via line 10 is therefore a gas that is charged with water and $H_2S$. In a variant of the process, the regeneration can be accomplished by circulating the regenerating gas from bottom to top in adsorber B. The gas that comes from adsorber B can be cooled in an exchanger E5, and it is then treated to eliminate $H_2S$ that is used in zone S2. It is possible to use, for example, a chemical absorption process that uses a catalytic solution which makes it possible to produce and decant elementary sulfur as described, for example, in the French application FR-A-2700713, in the name of the same applicant. The desulfurated gas leaves this zone via line 11. It is cooled by means of, for example, a cooling tower and optionally by additional water refrigeration E6. The condensed water is then recovered in a conventional separator.

Adsorber B is therefore gradually regenerated by elimination of the impurities ($H_2O$ and $H_2S$) that it contains.

After separation of the water and hydrogen sulfide, the gas which has been used for regeneration contains water at a content that is equal to its partial pressure at the temperature of the separator. It is then recompressed in compressor K3 and sent via line 12 to line 7 to be mixed with gas that is obtained from storage to be introduced into adsorber A.

The conditions of use are selected such that the gas that is drawn off constitutes the regenerating agent, and it therefore is not necessary to use an additional agent.

The set of these two adsorption zones therefore makes it possible to produce a gas that complies with the specifications for being sent to the network. During the draw-down phase, the odorant that is extracted during a prior storage phase can be reinjected into the gas that is sent to the network.

The draw-down phase can last, for example, several tens of days and comprises cycles whose half-period is, for example, several hours.

For the sake of simplicity, the preceding description of the invention utilizes two adsorbers A and B. It should be understood that in the invention, the use of more than two adsorbers may be made necessary by the flow conditions and the composition of the gas of the site in question. In this case, it is possible to use several adsorbers in the adsorption mode simultaneously, both in the storage phase and in the draw-down phase.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight.

The entire disclosure of all applications, patents and publications, cited above and below, and of corresponding application French 95/15524, are hereby incorporated by reference.

EXAMPLE

During the storage phase, which lasts approximately 100 days, a natural gas of average composition given in Table 1 and which obtained from the distribution network at a temperature of 25° C. and a pressure of 50 bar is introduced via line 1 at the bottom of an adsorber A in mode 1 at a flow rate of $10^5$ $Nm^3/h$.

TABLE 1

| Composition | mole % |
|---|---|
| N2 | 8. |
| C1 | 85. |
| C2 | 4. |
| C3 | 1. |
| ic4 | 0.1 |
| nC4 | 0.1 |
| C5+ | 0.1 |
| $CO_2$ | 1.7 |
| **Impurities** | **g/Nm3** |
| $H_2O$ | 50 |
| $H_2S$ | 5 |
| THT | 25 |

This adsorber contains 20 tons of molecular sieve that selectively absorbs sulfur-containing compounds and water. Adsorber A is kept in adsorption for a half-period of 10 days. The gas that emerges at the top of the adsorber is freed of its odorant and can therefore be sent to underground storage. Under adsorption conditions, the adsorbent is therefore charged with odorant for the entire half-period, and the superficial gas velocity in the adsorber is from 8 to 10 m/me. At the end of this half-period, adsorber A moves into regeneration mode 2, and adsorber B moves into adsorption mode 1. For a period of 8 hours, a portion of the purified gas that emerges from adsorber B is used to regenerate adsorber A. This fraction of the effluent (18%, or, in this example, $18\times10^3 Nm^3/h$) is heated first by a top/bottom exchanger and then by a furnace E1 to reach a temperature of 200° C. This hot gas passes rough the adsorber from top to bottom and desorbs odorant THT that is adsorbed during the adsorption phase. The effluent that emerges at the bottom is therefore charged with THT. This effluent is cooled first by the top/bottom exchanger already mentioned, and then by a cooling tower to reach the condensation temperature of the odorant, which is then recovered in a separator S1. At the outlet of separator S1, the gas is remixed, after compression in compressor K1, with the batch of adsorber B to be retreated. When this regeneration operation is completed, the adsorber is kept as is, waiting to be reused in adsorption.

The production phase of the underground storage lasts for almost 50 days. The natural gas which is contained in the underground storage, and which has the molar composition mean values given in Table 1 below but is saturated with water and with a content of $H_2S$ of 20 $mg/Nm^3$, emerges from storage at a temperature of 25° C. and a pressure of 50 bar. It is introduced at the bottom of adsorber A in adsorption mode 3 with a flow of $4\times10^5$ $Nm^3/h$.

Adsorber A is kept in adsorption mode 3 for 6 hours. The gas that emerges at the top of the adsorber is dehydrated and desulfurated and can therefore be sent to the network via line 8 without any other purification. The residual contents of $H_2O$ and $H_2S$ are, respectively, 15 $mg/Nm^3$ and 5 $mg/Nm^3$. Under adsorption conditions, the adsorbent is therefore charged with water and $H_2S$ during the entire period, and the superficial gas velocity in the adsorber is from 10 to 12 m/me. At the end of this period, adsorber A moves into regeneration mode 4 and adsorber B moves into adsorption mode 3. During a half-period that is equal to the adsorption half-period, a portion of the purified gas that emerges from adsorber B is used to regenerate adsorber A. This fraction of the effluent (16%, or $16\times10^3 Nm^3/h$) is heated first by a top/bottom exchanger and then by a furnace E4 to reach a temperature of 200° C. This hot gas passes through the adsorber from top to bottom and desorbs the components that are adsorbed during the adsorption phase (sulfur-containing products and water). The effluent which emerges at the bottom is therefore charged with impurities. This effluent is cooled by the top/bottom exchanger already mentioned before being introduced into a chemical absorption process that makes it possible to produce and decant elementary sulfur. At the end of this operation, the gas is saturated with water. It is then cooled to a temperature of 35° C. by a cooling tower, and the water is recovered in a separator S3. At the outlet of the separator, the gas is remixed, after recompression in compressor K3, with the batch of adsorber B to be retreated, since it is saturated with water. With this regeneration operation finished, adsorber A is reused in adsorption mode 3. The two adsorbers are therefore used alternately in adsorption and desorption with cycles of 12 hours (two half-periods of 6 hours).

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed:

1. A natural gas treatment process comprising passing natural gas containing condensable odorant through a storage phase and a draw-down phase, characterized in that at least two adsorbers A and B that operate alternately in at least one adsorption mode and in at least one desorption mode are used to remove the condensable odorant present in the gas that is to be fed into storage during the storage phase, and to remove impurities, at least water and hydrogen sulfide, present in the gas that comes from storage during the draw-down phase.

2. A process according to claim 1, wherein:

the storage phase comprises several cycles comprising at least two half-periods during which said two adsorbers A and B are used in an adsorption mode 1 and in a desorption mode 2 respectively during a first half-period; natural gas feed that contains the condensable odorant is sent into said adsorber A that contains an adsorbent which retains said odorant; at the outlet of said adsorber A, at least a portion of the gas is sent directly into an underground storage tank; the rest is sent as regenerating gas to adsorber B that operates in said desorption mode 2, after being heated to a suitable temperature and during the time that it takes to regenerate said adsorber B; the gas that comes out of said adsorber B and that contains the desorbed odorant is then cooled so as to condense a large portion of the odorant which is then collected; the resultant partially purified gas is merged with feed to adsorber A; adsorbers A and B are then interchanged, with adsorber B then being used in the adsorption mode and adsorber A in the desorption mode, during a second half-period of the cycle;

and wherein the draw-down phase also comprises several cycles that comprise at least two half-periods during which adsorbers A and B are used in an adsorption mode 3 and in desorption mode 4; during a first half-period, the natural gas that comes from storage and that contains as impurities at least water and hydrogen sulfide is sent to adsorber A that operates in adsorption mode 3 and contains an adsorbent which retains the water and the hydrogen sulfide; at the outlet of said adsorber A, a first portion of the gas is sent directly into a natural gas network; a second portion of the gas is sent as regenerating gas to adsorber B that operates in desorption mode 4 at a suitable desorption temperature; the gas that comes out of said adsorber B, that contains desorbed water and hydrogen sulfide, is subjected to treatment to remove hydrogen sulfide, the $H_2S$-depleted gas is then cooled to separate a large portion of the water by condensation; the resultant gas thus partially purified is merged with the feed to adsorber A; adsorbers A and B are then interchanged during a second half-period of the cycle, during which adsorber B is used in the adsorption mode and adsorber A in the desorption mode.

3. A process according to claim 2, wherein during the storage phase, the portion of the gas that is sent to adsorber B in desorption mode 4 represents 5 to 30% of the gas that comes from adsorber A in adsorption mode 3.

4. A process according to claim 3, wherein said portion of the gas sent to adsorber B in desorption mode 4 represents 15 to 20% of the gas that comes from adsorber A in adsorption mode 3.

5. A process according to claim 2, wherein said portion of the gas sent to adsorber B in desorption mode 2 represents 15 to 20% of the gas that comes from adsorber A in adsorption mode 1.

6. A process according to claim 1 or 2, wherein each adsorber contains at least one molecular sieve absorbent.

7. A process according to claim 6, wherein the molecular sieve is selected from among sieves A, sieves X and Y, and MFI sieves.

8. A process according claim 1, wherein the gas to be fed to storage moves from bottom to top through the adsorber A that operates in the adsorption mode.

9. A process according to claim 1, wherein the regeneration gas moves from top to bottom through the adsorber B that operates in the desorption mode.

10. A process according to claim 1, wherein the storage phrase lasts about one hundred days with cycles whose period is from several hours to several days each period comprising a regeneration half-period and an adsorption half-period, and wherein the draw-down phase lasts for several tens of days with cycles whose half-period is several hours.

11. A process according to claim 10, wherein during the storage phase the regeneration half-period is comprised of (1) a regeneration time, where a portion of the gases that are obtained from adsorber A is sent to adsorber B and (2) a waiting time, where all the gas that comes from adsorber A is sent into storage.

12. A process according to claim 11, wherein during the storage phase, during a half-period of adsorption by adsorber A, regeneration of adsorber B is carried out during a time span of 5 to 10 hours.

13. A process according to claim 11, wherein during the storage phase, the portion of the gas that is sent to adsorber B in desorption mode 2 represents 5 to 30% of the gas that comes from adsorber A in adsorption mode 1, during the regeneration time.

14. A process according to claim 1, wherein during the storage phase or the draw-down phase, said at least two adsorbers comprise at least three adsorbers, at least two of which are used simultaneously in adsorption.

15. A process according to claim 1, wherein the odorant that is extracted from the gas during the storage phase is reinjected into the gas that comes from a subsequent draw-down phase.

16. A process according to claim 1, wherein the odorant is tetrahydrothiophene (THT).

* * * * *